US007144670B2

(12) United States Patent
Kayamoto et al.

(10) Patent No.: US 7,144,670 B2
(45) Date of Patent: Dec. 5, 2006

(54) CARRIER FOR ELECTROPHOTOGRAPHIC DEVELOPER AND PROCESS OF PRODUCING THE SAME

(75) Inventors: Kanao Kayamoto, Kashiwa (JP); Issei Shinmura, Kashiwa (JP); Yuji Sato, Kashiwa (JP)

(73) Assignee: Powertech Co., Ltd., Chiba (JP)

( * ) Notice: Subject to any disclaimer, the term of this patent is extended or adjusted under 35 U.S.C. 154(b) by 0 days.

(21) Appl. No.: 10/393,289

(22) Filed: Mar. 21, 2003

(65) Prior Publication Data

US 2003/0186156 A1 Oct. 2, 2003

(30) Foreign Application Priority Data

Mar. 26, 2002 (JP) ..... 2002-085633

(51) Int. Cl.
*G03G 9/107* (2006.01)
*G03G 9/113* (2006.01)

(52) U.S. Cl. ..... 430/111.32; 430/111.41

(58) Field of Classification Search ..... 430/111.32, 430/111.33, 111.35, 111.41, 111.31
See application file for complete search history.

(56) References Cited

U.S. PATENT DOCUMENTS 3,996,392 A 12/1976 Berg et al. ..... 427/18
5,884,129 A 3/1999 Ichimura et al. ..... 399/252
6,074,794 A * 6/2000 Fushimi et al. ..... 430/109.2
6,210,850 B1 * 4/2001 Ogata et al. ..... 430/111.1
2002/0006567 A1 * 1/2002 Matsuda et al. ..... 430/108.6
2003/0054279 A1 * 3/2003 Yamaguchi et al. .... 430/111.35

FOREIGN PATENT DOCUMENTS

EP 1 255 168 A1 11/2002
JP A 9-197721 7/1997
JP A 2001-27828 1/2001

OTHER PUBLICATIONS

Grant, R. et al., ed., *Grant & Hackh's Chemical Dictionary*, Fifth Ed, McGraw-Hill Book Co, NY (1987), p. 547.*
Patent Abstracts of Japan, Abstract Describing JP 60-144758 (published Jul. 1985).
Patent Abstracts of Japan, Abstract Describing JP 60-060930 (published Apr. 1985).
Patent Abstracts of Japan, Abstract Describing JP 02-223962 (published Sep. 1990).

* cited by examiner

*Primary Examiner*—Janis L Dote
(74) *Attorney, Agent, or Firm*—Young & Thompson

(57) ABSTRACT

A resin-coated carrier for an electrophotographic developer and a process of producing the carrier. The carrier comprises a ferrite core mainly comprising iron oxide, primarily having a spinel structure, and having a volume average particle size of 20 to 45 μm and a resin coat, wherein the carrier has a magnetization of 65 to 80 emu/g in a magnetic field of 1 KOe, the core has an electric current value of 50 to 150 μA and a surface smoothness uniformity of 75% or higher, and the amount of the resin coat is 0.1 to 5.0% by weight based on the core.

3 Claims, No Drawings

CARRIER FOR ELECTROPHOTOGRAPHIC DEVELOPER AND PROCESS OF PRODUCING THE SAME

BACKGROUND OF THE INVENTION

1. Field of the Invention

The present invention relates to a carrier for an electrophotographic developer and a process of producing the same. More particularly, it relates to a carrier which, when applied to full color electrophotographic developers, achieves excellent image characteristics and extended service life and to a process of producing the carrier.

2. Description of the Related Art

Electrophotography comprises the steps of charging and imagewise exposing a photoreceptor to form an electrostatic latent image thereon, developing the latent image with a developer containing a toner, and transferring and fixing the toner image onto a recording medium. The developer includes a two-component developer comprising a toner and a carrier and a one-component developer such as a magnetic toner.

A two-component developer containing a carrier is widely used as a full color developer or a developer for high-speed developing apparatus by virtue of its advantages such as excellent image quality.

Full color developers which have recently enjoyed an increasing demand are required to rapidly charge a supplied toner and to have capability of continuous development over a broad recording area. Further, advanced electrophotographic recording equipment is getting more compact with a smaller developing sleeve diameter, and the amount of the developer to be loaded has been reduced. These trends have boosted the demand for a carrier for the developer to have improved charging capabilities, an extended service life, and capability of realizing high image quality.

Under these circumstances, a carrier to be used is required to have toner holding capability, toner charging capability, and a reduced particle size for making a softer magnetic brush. Carrier scattering is a constant problem that accompanies size reduction of carrier particles, and a number of countermeasures against this have been proposed.

JP-A-9-197721 proposes a carrier that does not cause an image defect due to carrier adhesion even in high-speed development and a developer containing the carrier. In the proposal, the size of primary particles of a raw material is specified in terms of number average primary particle diameter (Dv) and a volume average primary particle diameter (Dn) to achieve uniformization of magnetization in an attempt to solve the carrier scattering problem. However, it turned out impossible to prevent scattering of small-diameter ferrite particles having an average particle size of 20 to 45 μm even where the Dv/Dn ratio falls within the range of from 1.0 to 2.0 as specified.

The carrier core particles tested in Examples of JP-A-9-197721 supra have an average particle size of 65 μm. It appears that the contemplated effects are little exerted on such carrier particles as small as 20 to 45 μm that scatter easily. It is also assumed that average size reduction of carrier particles requires, of necessity, size reduction of the raw material.

A number of proposals have also been made with regard to magnetic characteristics or particle size distribution of a carrier for being held in a magnetic brush.

For example, JP-A-2001-27828 discloses a carrier which has a weight average particle size of 35 to 55 μm, contains 0 to 15% of particles smaller than 22 μm and 0 to 5% of particles greater than 88 μm, has a specific resin coat, and exhibits a magnetization of 70 to 120 emu/g in a magnetic field of 1 KOe. A carrier having a higher magnetization is admittedly show a wider margin against scattering but, in turn, forms a harder magnetic brush, which will make it difficult to achieve high-quality soft development.

A carrier having a reduced content of particles in the smaller size region of size distribution tends to show better results in connection with the carrier scattering problem, as have been suggested in many reports. However, there are limits in this regard from the technical aspect (e.g., limits of classifying technique and yield) and the economical aspect.

A large number of proposals have been made with respect to small-diameter carriers. Nevertheless, mere application of techniques on conventional ferrite carriers having an average particle size of 60 μm or greater to ferrite carriers having an average particle size of 20 to 45 μm fails to sufficiently settle the carrier scattering problem.

SUMMARY OF THE INVENTION

An object of the present invention is to provide a carrier for an electrophotographic developer which has a successfully reduced particle size and is yet free from the scattering problem, and, when applied to a full color developer, exhibits excellent performance including image characteristics.

Another object of the present invention is to provide a process of producing the carrier.

As a result of extensive investigation, the present inventors have succeeded in designing a carrier for an electrophotographic developer which exhibits sharp magnetic characteristics and therefore has a wide margin against scattering by adopting a strategy for allowing a raw material to undergo a uniform reaction for ferrite formation thereby equalizing magnetic characteristics among individual carrier particles.

The present invention provides a resin-coated carrier for an electrophotographic developer which comprises a ferrite core mainly comprising iron oxide, primarily having a spinel structure, and having a volume average particle size of 20 to 45 μm and a resin coat, wherein the carrier has a magnetization of 65 to 80 emu/g in a magnetic field of 1 KOe, the core has an electric current value of 50 to 150 μA and a surface smoothness uniformity of 75% or higher, and the amount of the resin coat is 0.1 to 5.0% by weight based on the core.

The present invention also provides a process of producing a resin-coated carrier for an electrophotographic developer which comprises granulating a slurried raw material, firing the granules, disintegrating the fired product, classifying the resulting particles to obtain a core, and coating the core with a resin, wherein:

the primary particle sizes Ds10 and Ds90 of the slurried raw material satisfy the formulae:

$$Ds90 \leqq 1\ \mu m \text{ and}$$

$$2.0 \leqq Ds10/Ds90 \leqq 10.0$$

wherein Ds10 and Ds90 are a 10% volume diameter and a 90% volume diameter, respectively, both measured on ground particles of the raw material.

DETAILED DESCRIPTION OF THE PREFERRED EMBODIMENT

The carrier according to the present invention is a ferrite carrier mainly comprising iron oxide, primarily having a spinel structure, and having a volume average particle size of 20 to 45 μm. The specified volume average particle size copes with the current demand of carrier size reduction. The volume average particle size is measured with a MICROTRAC particle size analyzer 9320-X100, supplied by Nikkiso Co., Ltd.

The carrier of the present invention should satisfy the following requirements:

(1) The magnetization in a magnetic field of 1 KOe ranges from 65 to 80 emu/g. The magnetization in a magnetic field of 1 KOe is measured with a vibration sample magnetometer VSM-P7, supplied by Toei Kogyo K.K. A carrier whose magnetization is less than 65 emu/g has too weak force to be held on a magnetic roll and scatters easily. A carrier whose magnetization is more than 80 emu/g forms a hard magnetic brush, resulting in a failure to conduct soft development.

(2) The core of the carrier shows an electric current value of 50 to 150 μA. The electric current of a carrier core is measured by setting 500 g of the carrier core in a developing machine facing an aluminum pipe as a probe electrode and reading the electric current value with a direct current of 200 V applied. A carrier whose current value is lower than 50 μA has insufficient developing capabilities. A carrier whose current value is higher than 150 μA can cause leakage or like problems.

(3) The core of the carrier has a surface smoothness uniformity of 75% or higher. The term "surface smoothness uniformity" as used herein denotes a ratio of (a) the number of core particles, over at least half the total surface area of which is smooth, per (b) the number of all the particles. These numbers are counted within a field of vision, at an observation by scanning electron microscope (at a magnifying power of 200). The ratio is represented by the formulae:

$$(a)/(b)*100(\%).$$

Where the carrier core has a surface smoothness uniformity of less than 75%, the carrier shows wide particle-to-particle variation in ferrite forming reaction, and those carrier particles having low magnetizations easily scatter.

(4) The carrier core is coated with 0.1 to 5.0% by weight of a resin based on the core. If the resin coating weight is less than 0.1%, the effects of a resin coat on charge control and resistivity control are lessened. A resin coating weight exceeding 5.0% by weight gives rise to such problems as a slow rise of charge quantity and a reduction in yield due to sticking of resin-coated particles to each other.

The resin for coating the carrier core is chosen in relation to a toner used in combination. Useful coating resins include polypropylene, polystyrene, acrylic resins, polyacrlonitrile resins, straight silicone resins, modified silicone resins, fluororesins, such as polytetrafluoroethylene and polyvinylidene fluoride, polycarbonate resins, and epoxy resins. These resins can be used either individually or as a mixture thereof, or as modified. For obtaining high image quality and a long life, resin materials containing a silicone resin or a fluororesin are preferred for their high resistance against contamination with a toner.

Since use of an insulating resin as a coating resin would result in high resistivity, a known conductive agent, such as carbon black or titanium oxide, can be dispersed in the coating resin, if necessary.

Because the carrier core used in the present invention has uniform surface properties as specified above, the resin is allowed to coat the core to a uniform thickness to provide a resin-coated carrier that is markedly excellent in charge quantity distribution and durability.

Methods of coating the carrier core with the resin include a dip coating method in which the core is dipped in a resin solution and dried, a fluidized-bed coating method in which a resin solution is sprayed to a fluidized core, and a dry method in which the resin and the core are heated while being blended.

The carrier according to the present invention is produced by a process comprising granulating a slurried raw material, firing, disintegrating, classifying, and coating the resulting carrier core particles with a resin.

In the process according to the present invention, the primary particle sizes Ds10 and Ds90 of the slurried raw material must satisfy the formulae:

$$Ds90 \leqq 1\ \mu m \text{ and}$$

$$2.0 \leqq Ds10/Ds90 \leqq 10.0$$

wherein Ds10 and Ds90 are a 10% volume diameter and a 90% volume diameter, respectively, both measured on ground particles of the raw material.

Ds10, the volume particle diameter of primary particles of the slurried raw material, represents the particle size at a 10% accumulation as to the cumulative distribution of a particle diameter, and Ds90 represents the particle size at a 90% accumulation as to the cumulative distribution of a particle diameter. It has turned out to be important in the production of the carrier core that the Ds10/Ds90 ratio be optimized so as to granulate the slurry into granules of closest packed structure having a uniform composition.

JP-A-9-187721 cited supra proposes limiting the volume average primary particle size (Mv)/number average primary particle size (Mn) ratio within a range of 1.0 to 2.0. The present inventors analyzed particles ground under varied grinding conditions starting from a standard level and clarified the changes of results shown in Table 1 below. The analysis was made with a MICROTRAC particle size analyzer 9320-X100, supplied by Nikkiso Co., Ltd.

TABLE 1

| Grinding Condition* | 1 | 2 | 3 | 4 | 5 |
|---|---|---|---|---|---|
| Mv (μm) | 2.784 | 2.214 | 1.899 | 1.624 | 1.368 |
| Mn (μm) | 2.342 | 1.894 | 1.611 | 0.189 | 0.189 |
| Ds10 (μm) | 3.442 | 2.855 | 2.482 | 2.31 | 2.211 |
| Ds90 (μm) | 2.113 | 1.638 | 1.342 | 0.963 | 0.244 |
| Mv/Mn | 1.19 | 1.17 | 1.18 | 8.59 | 7.24 |
| Ds10/Ds90 | 1.63 | 1.74 | 1.85 | 2.40 | 9.06 |

*Intensified from level 1 (standard level) to level 5.

As shown in Table 1, the primary particle size distribution resulting from level 3 grinding falls within the range specified by the related art but, as the grinding condition is intensified, the size distribution deviates from that range, which reveals that the particles ground under the level 4 or 5 condition have a size distribution with two peaks, an additional one in the fine size region. The differences in characteristics of resulting granules between the level 3 or milder condition and the level 4 or 5 condition (Ds10/Ds90=2.0 to 10.0) are considered attributable to the two-peak size distribution.

Where the particles ground under different grinding conditions are granulated into granules having an average particle size of 20 to 45 μm, which are then fired, it was confirmed that the surface properties and sphericity of the carrier core show large changes with intensification of grinding conditions. That is, the carrier core prepared from the primary particles which are obtained by grinding under the level 4 or 5 condition exhibits markedly improved surface properties and sphericity.

Further, measuring the amount of a scattered carrier revealed that a carrier from the primary particles ground under the level 4 or 5 condition is less liable to scatter than those from the primary particles ground under the levels 1 to 3 conditions.

As long as a carrier core has an average particle size around 80 μm as in conventional techniques, the primary particles obtained by grinding under the level 3 or milder conditions are sufficient to achieve uniform surface properties and sphericity. However, where the primary particles of conventional levels are applied to formation of carrier cores having reduced average particle sizes, the ferrite forming reaction becomes nonuniform probably because of segregation of a constituent raw material or variation of thermal history. As a result, generation of low-magnetization products is involved, and the resulting carrier shows increased scattering.

Accordingly, it is essential that $Ds90 \leqq 1$ μm and $2.0 \leqq Ds10/Ds90 \leqq 10.0$. If a Ds90 is greater than 1 μm or a Ds10/Ds90 ratio is less than 2.0, the particles making up granules are so large that the ferrite forming reaction takes place with particle-to-particle variations and the resulting carrier shows increased scattering. If Ds10/Ds90 exceeds 10.0, the raw material particles are so reactive that they are liable to adhere to each other on firing, resulting in deteriorated shapes.

In order to cause uniform ferrite forming reaction, the process of the present invention preferably includes the step of removing fine powder before firing the granules. Because ferrite granules having a smaller particle size exhibit higher reactivity with heat, granules containing fine powder have broad distribution of reactivity when heated and hardly react uniformly. Besides, the fine powder enters inter-particle gaps to make the gaps smaller. Such densely packed granules hardly convey heat of firing among the granules, which hinders uniform firing. Further, fine powder easily adheres to other particles and can cause carrier's scattering and deterioration of shape (sphericity). For these reasons, it is preferred to remove fine powder prior to firing. Not only fine powder but coarse powder can be removed.

Additives, such as a binder, can generate a reducing gas on firing to cause variation of ferrite forming reaction. Therefore, it is desirable to remove them after fine powder removal by heating at 700 to 900° C.

In the step of firing, the granules are preferably fired in an atmosphere having an oxygen concentration of not more than 0.05%. In the production of a high magnetization ferrite carrier, uniform firing is achievable in an inert and stable firing atmosphere having a low oxygen concentration. The firing temperature preferably ranges 1100 to 1350° C. The retention time at the maximum temperature is preferably 1 to 6 hours.

The fired product is released from the firing atmosphere at the product temperature of 400° C. or lower. When released at a product temperature exceeding 400° C., the fired product can generate a low-magnetization product due to re-oxidation and the like.

By the above-described process/condition design, it is possible to uniformize thermal history, reactivity, and composition of the fired product, which naturally leads to uniformity in magnetic characteristics and electrical resistance. It follows that the resulting carrier core has uniform surface properties and a given sphericity.

After the fired product is disintegrated and classified, it is preferred that the surface of the carrier core be subjected to a uniform heat treatment at 400 to 600° C. in the air and then to a mechanochemical treatment to further uniformize the surface resistivity.

In the final step, the carrier core is coated with the resin to produce a resin-coated carrier for an electrophotographic developer.

According to the process of the present invention, there is provided with good productivity a small-diameter carrier which shows small variations in surface properties, magnetic properties, and resistance and exhibits high surface uniformity and a wide margin against carrier scattering.

The electrophotographic developer according to the present invention comprises the carrier of the present invention and a toner having an average particle size of 4 to 10 μm. If desired, the developer may further comprise inorganic fine particles having an average particle size of 1.0 μm or smaller.

The toner which can be used in the present invention is made up of a binder and a colorant. The binder includes, but is not limited to, epoxy resins, polyester resins, styrene resins, acrylic resins, polyamide resins, olefin resins, vinyl acetate polymers, polyether polyurethane, paraffin wax, and copolymers comprising the monomers of these polymers. The binders can be used either individually or as a mixture thereof The colorant widely includes carbon black, Nigrosin, Aniline Blue, Chromium Yellow, Ultramarine Blue, Permanent Red, and Hansa Yellow.

The inorganic fine particles having an average particle size of 1.0 μm or smaller, which can be added to the developer, include fluidizing agents and charge control agents.

Electrophotography using the developer of the present invention is of the type in which a magnetic brush is formed of the developer on a developing sleeve having a magnet inside, and an electrostatic latent image of an electrostatic latent image holding member is visualized with the magnetic brush.

The present invention will now be illustrated in greater detail with reference to Examples. Unless otherwise specified, all the percents and parts are by weight.

EXAMPLE 1

1) Preparation of Carrier 1

A mixture consisting of 55 mol % of iron oxide, 40 mol % of manganese oxide, and 5 mol % of magnesium oxide to make 100 mol % and 0.8 mol %, based on the mixture of the iron oxide, manganese oxide, and magnesium oxide, of strontium oxide were mixed. A binder, a dispersant, and an antifoaming agent were added to the mixture. The mixture was wet ground in an attritor at a solids content of 55% to prepare a slurry (designated slurry 1). The dispersed particles in slurry 1 had a Ds10 of 2.14 μm, a Ds90 of 0.24 μm, and a Ds10/Ds90 ratio of 8.92 as shown in Table 2. The Mv, Mn, and Mv/Mn of the dispersed particles are shown in Table 2.

Slurry was spray dried to obtain spherical granules having an average particle size of 30 μm. Fine powder of 20 μm or smaller was removed from the granules by pneumatic classification. The additives, such as the binder, were removed by heating in a rotary kiln at 700° C. The granules were fired in an electric oven capable of creating a firing atmosphere as designed under conditions of oxygen concentration: 0.05% or lower; firing temperature: 1300° C.; retention time at the maximum temperature: 5 hours; and fired product temperature at release from the firing atmosphere: 350° C. The fired product was disintegrated and classified to obtain a carrier core having an average particle size of 35 μm.

The carrier core was surface treated in a continuous rotary kiln at an oxygen concentration of 21% and a temperature of 500° C. and then rotated in a rotary container to be given mechanochemical stress to have an increased surface resistivity.

The surface smoothness uniformity of the resulting carrier core was 85%. The physical properties of the carrier core (inclusive of surface smoothness uniformity, average particle size, magnetic characteristics, and electric current value) are shown in Table 3.

The carrier core particles were coated with 2.0% of a silicone resin SR-2411 (available from Dow Corning Toray Silicone Co., Ltd.) in a fluidized bed coating apparatus and then baked at 250° C. for 3 hours. The particles were classified with a 250 mesh sieve and then with a magnetic separator to obtain a carrier (designated carrier 1).

2) Preparation of Toner 1

A hundred parts of a polyester resin obtained by condensation of propoxylated bisphenol and fumaric acid, 4 parts of a phthalocyanine pigment, and 4 parts of a chromium complex of di-t-butylsalicylic acid were thoroughly premixed in a HENSCHEL MIXER. The mixture was melt-kneaded in a twin-screw extruder. After cooling, the mixture was crushed to particle sizes of about 1.5 μm in a hammer mill and then pulverized in a jet mill. The particles were classified to obtain a cyan color powder having a weight average particle size of 8.2 μm. A hundred parts of the powder and one part of titanium oxide having an average particle size of 0.05 μm were blended in a Henschel mixer to obtain a toner (designated toner 1).

3) Evaluation of Developer

Carrier 1 and toner 1 were blended to prepare a developer having a toner concentration of 8%. The developer was loaded on a full color copier (modified from ARC-250 supplied by Sharp Corp.) and tested for image forming performance in the initial stage of copying and in the stage of producing 100,000 copies according to the test methods described below. The results, rated A to E according to the standards given below, are shown in Table 4. Ratings A to C indicate levels acceptable for practical use in every attribute tested.

(1) Image Density

Copying was carried out under proper exposure conditions. The solid image density of the resulting copies was measured with X-Rite supplied by Nihon Heiban Kizai K.K.

A . . . Very good
B . . . Within an aimed range
C . . . Slightly low and yet acceptable
D . . . Lower than the lower limit of an aimed range
E . . . Very low and unacceptable (2) Fog Density A . . . Lower than 0.5
B . . . 0.5 to 1.0
C . . . 1.0 to 1.5
D . . . 1.5 to 2.5
E . . . 2.5 and higher (3) Carrier Scattering The number of white spots in the image area due to carrier scattering to the photoreceptor was counted.

A . . . No white spots in 10 sheets of A3 size.
B . . . 1 to 5 white spots in 10 sheets of A3 size
C . . . 6 to 10 white spots in 10 sheets of A3 size
D . . . 11 to 20 white spots in 10 sheets of A3 size
E . . . 21 or more white spots in 10 sheets of A3 size (4) Toner Scattering A . . . Not at all observed
B . . . Very slight
C . . . Acceptable
D . . . Considerable
E . . . Very considerable (5) Transverse Line Reproducibility A . . . Very good
B . . . Good
C . . . Acceptable
D . . . Poor with noticeable cuts or scratches
E . . . Not at all reproduced (6) Half Tone Uniformity A . . . Very uniform
B . . . Uniform
C . . . Slightly non-uniform and yet acceptable
D . . . Non-uniform
E . . . Very non-uniform (7) Toner Concentration Stability A . . . Very stable
B . . . Stable
C . . . Slightly instable
D . . . Varied
E . . . Much varied

EXAMPLE 2

A mixture consisting of 55 mol % of iron oxide, 40 mol % of manganese oxide, and 5 mol % of magnesium oxide to make 100 mol % and 0.8 mol %, based on the mixture of iron oxide, manganese oxide, and magnesium oxide, of strontium oxide were mixed. A binder, a dispersant, and an antifoaming agent were added to the mixture. The mixture was wet ground in an attritor at a solids content of 55% to prepare a slurry (slurry 2). The dispersed particles in slurry 2 had a Ds10 of 2.36 μm, a Ds90 of 0.96 μm, and a Ds10/Ds90 ratio of 2.46. The Mv, Mn, and Mv/Mn of the dispersed particles are shown in Table 2.

Slurry 2 was spray dried to obtain spherical granules. Fine powder of 16 μm or smaller was removed from the granules by pneumatic classification. The granules were processed in the same manner as in Example 1, except for changing the firing temperature to 1280° C., to obtain a resin-coated carrier (carrier 2), of which the core had an average particle size of 25 μm. The surface smoothness uniformity of the carrier core was 80%. The physical properties of the carrier core are shown in Table 3. A developer was prepared and evaluated in the same manner as in Example 1. The results of evaluation are shown in Table 4.

EXAMPLE 3

The same raw materials as used in Example 1 were ground and dispersed to prepare a slurry (slurry 3) having a Ds10 of 1.76 μm, a Ds90 of 0.26 μm, and a Ds10/Ds90 ratio of 6.77 (measured with a Microtrack particle size analyzer) as shown in Table 2. The Mv, Mn, and Mv/Mn of the dispersed particles are also shown in Table 2.

Slurry 3 was spray dried to obtain spherical granules. Fine powder of 24 μm or smaller was removed from the granules by pneumatic classification. The additives, such as the binder, were removed by heating in a rotary kiln at 700° C. The granules were processed in the same manner as in Example 1, except for changing the firing temperature to 1320° C., to obtain a resin-coated carrier (carrier 3), of which the core had an average particle size of 45 μm and a surface smoothness uniformity of 90%. The physical properties of the carrier core are shown in Table 3. A developer was prepared and evaluated in the same manner as in Example 1. The results of evaluation are shown in Table 4.

Comparative Example 1

The same raw materials as used in Example 1 were ground and dispersed to prepare slurry 4 having a Ds10 of 3.58 μm, a Ds90 of 2.10 μm, and a Ds10/Ds90 ratio of 1.70 (measured with a Microtrack particle size analyzer) as shown in Table 2. The Mv and Mn of the dispersed primary particles were 2.80 μm and 2.467 μm, respectively, giving an Mv/Mn ratio of 1.13.

The resulting slurry was spray dried to obtain spherical granules having an average particle size of 30 μm. The granules were processed in the same manner as in Example 1 to obtain resin-coated carrier 4, of which the core had a surface smoothness uniformity of 65%. The physical properties of the carrier core are shown in Table 3. A developer was prepared and evaluated in the same manner as in Example 1. The results of evaluation are shown in Table 4.

Comparative Example 2

Slurry 5 was prepared in the same manner as in Example 1, except for using 50 mol % of iron oxide, 40 mol % of manganese oxide, 10 mol % of magnesium oxide, and 0.5 mol %, based on the total of iron oxide, manganese oxide and magnesium oxide, of strontium oxide.

The resulting slurry was spray dried, and the resulting granules were processed in the same manner as in Example 1, except that removal of fine powder was not conducted, to obtain carrier 5. The core of the carrier 5 had a surface smoothness uniformity of 65%. The physical properties of the carrier core are shown in Table 3. A developer was prepared and evaluated in the same manner as in Example 1. The results of evaluation are shown in Table 4.

Comparative Example 3

Carrier 6 was prepared in the same manner as in Example 1, except for using 80 mol % of iron oxide and 20 mol % of manganese oxide. The core of carrier 6 had a surface smoothness uniformity of 55%. The physical properties of the carrier core are shown in Table 3. A developer was prepared and evaluated in the same manner as in Example 1. The results of evaluation are shown in Table 4.

TABLE 2

| | Carrier | Mv | Mn | Mv/Mn | Ds10 | Ds90 | Ds10/Ds90 |
|---|---|---|---|---|---|---|---|
| Ex. 1 | 1 | 1.37 | 0.193 | 7.10 | 2.14 | 0.24 | 8.92 |
| Ex. 2 | 2 | 1.64 | 0.192 | 8.54 | 2.36 | 0.96 | 2.46 |
| Ex. 3 | 3 | 1.13 | 0.214 | 5.28 | 1.76 | 0.26 | 6.77 |
| Comp. Ex. 1 | 4 | 2.80 | 2.467 | 1.13 | 3.58 | 2.10 | 1.70 |
| Comp. Ex. 2 | 5 | 1.41 | 0.189 | 7.46 | 2.25 | 0.65 | 3.46 |
| Comp. Ex. 3 | 6 | 1.46 | 0.192 | 7.60 | 2.33 | 0.32 | 7.28 |

TABLE 3

| | Carrier | Surface Smoothness Uniformity (%) | Average Particle Size (μm) | Magnetization at 1KOe (emu/g) | Current (μA) |
|---|---|---|---|---|---|
| Ex. 1 | 1 | 85 | 35 | 68 | 88 |
| Ex. 2 | 2 | 80 | 25 | 69 | 67 |
| Ex. 3 | 3 | 90 | 45 | 69 | 98 |
| Comp. Ex. 1 | 4 | 65 | 35 | 70 | 68 |
| Comp. Ex. 2 | 5 | 65 | 35 | 60 | 40 |
| Comp. Ex. 3 | 6 | 55 | 35 | 85 | 170 |

TABLE 4

| | Example | | | Compara. Example | | |
|---|---|---|---|---|---|---|
| | 1 | 2 | 3 | 1 | 2 | 3 |
| Initial stage: | | | | | | |
| Image density | A | A | A | A | A | A |
| Fog density | A | A | A | C | C | B |
| Toner scattering | A | A | A | C | B | B |
| Carrier scattering | A | B | A | E | E | B |
| Transverse line reproducibility | A | A | B | D | B | E |
| Half tone uniformity | A | A | B | D | E | E |
| Stage of producing 100,000 copies: | | | | | | |
| Image density | A | A | A | B | A | D |
| Fog density | A | A | B | C | C | B |
| Toner scattering | A | B | A | C | B | E |
| Carrier scattering | A | A | A | E | E | B |
| Transverse line reproducibility | A | A | B | D | B | E |
| Half tone uniformity | A | A | B | D | E | E |
| Toner concentration stability | A | A | B | C | C | E |

As is apparent from the results in Table 3, Examples 1 to 3 show higher surface smoothness uniformity than Comparative Examples 1 to 3 and have magnetic characteristics and current values in the respective proper ranges. As shown in Table 4, Examples 1 to 3 exhibit superiority to Comparative Examples 1 to 3 in image characteristics in both the initial stage and the stage of 100,000 copies production.

The present invention has accomplished size reduction of a carrier for an electrophotographic developer while solving the carrier scattering problem. The carrier of the present invention, when applied to a full color developer, achieves excellent performance such as image characteristics. The process according to the present invention produces the carrier with good productivity.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

This application claims the priority of Japanese Patent Application No. 2002-85633 filed Mar. 26, 2002, which is incorporated herein by reference.

What is claimed is:

1. A resin-coated carrier for an electrophotographic developer which comprises a ferrite core mainly comprising iron oxide, primarily having a spinel structure, and having a volume average particle size of 20 to 45 μm and a resin coat, wherein said carrier has a magnetization of greater than 68 emu/g and up to 80 emu/g in a magnetic field of 1 KOe, said core has an electric current value of 50 to 150 μA and a surface smoothness uniformity of 75% or higher, and the amount of said resin coat is 0.1 to 5.0% by weight based on the core.

2. An electrophotographic developer comprising the carrier according to claim 1 and a toner having an average particle size of 4 to 10 μm.

3. An electrophotographic developer comprising the carrier according to claim 1, wherein said carrier has a magnetization of greater than 69 emu/g.

* * * * *

UNITED STATES PATENT AND TRADEMARK OFFICE

CERTIFICATE OF CORRECTION

PATENT NO. : 7,144,670 B2
APPLICATION NO. : 10/393289
DATED : December 5, 2006
INVENTOR(S) : Kanao Kayamoto et al.

It is certified that error appears in the above-identified patent and that said Letters Patent is hereby corrected as shown below:

Title Page
Item (73) Change the name of the assignee on the printed patent from "Powertech Co., Ltd." to --Powdertech Co., Ltd.--

Signed and Sealed this

Sixth Day of March, 2007

JON W. DUDAS
*Director of the United States Patent and Trademark Office*